US009926743B1

(12) United States Patent
Eatmon

(10) Patent No.: US 9,926,743 B1
(45) Date of Patent: Mar. 27, 2018

(54) LADDER CONVERTIBLE TO A SCAFFOLD

(71) Applicant: Julie Eatmon, Detroit, MI (US)

(72) Inventor: Julie Eatmon, Detroit, MI (US)

( * ) Notice: Subject to any disclaimer, the term of this patent is extended or adjusted under 35 U.S.C. 154(b) by 0 days.

(21) Appl. No.: 15/284,899

(22) Filed: Oct. 4, 2016

(51) Int. Cl.
*E06C 1/393* (2006.01)
*E06C 1/18* (2006.01)
*E04G 5/14* (2006.01)
*E04G 1/00* (2006.01)

(52) U.S. Cl.
CPC ..... *E06C 1/393* (2013.01); *E04G 1/00* (2013.01); *E04G 5/14* (2013.01); *E06C 1/18* (2013.01)

(58) Field of Classification Search
CPC ... E06C 1/39; E06C 1/393; E06C 1/18; E06C 1/20; E04G 1/00
USPC ..... 182/20, 21, 22, 23, 24, 25, 26, 27, 28, 182/29, 30, 31, 32, 33, 33.2, 33.3, 33.4, 182/33.5, 33.6, 34, 35
See application file for complete search history.

(56) References Cited

U.S. PATENT DOCUMENTS 1,636,085 A * 7/1927 Wittek ..... E06C 1/39 182/118
1,894,489 A * 1/1933 Jun ..... E06C 1/32 182/125
1,942,210 A * 1/1934 Harting ..... E06C 1/32 182/178.2
3,014,552 A * 12/1961 Fike ..... E06C 1/18 182/104
3,042,140 A * 7/1962 Basile ..... E06C 1/39 182/125
3,208,553 A * 9/1965 Gray ..... E06C 1/32 182/119
3,474,881 A * 10/1969 Green ..... E06C 1/32 182/163
3,500,957 A * 3/1970 Stern ..... E06C 1/18 182/104
3,566,990 A * 3/1971 Fredricks ..... E04G 1/34 182/119
4,060,150 A * 11/1977 Hughes ..... E06C 1/10 182/151
4,284,171 A * 8/1981 Owen ..... E04G 1/30 182/119
4,951,780 A * 8/1990 Kim ..... E04G 1/30 182/119

(Continued)

FOREIGN PATENT DOCUMENTS

CN 201649601 11/2010

*Primary Examiner* — Katherine W Mitchell
*Assistant Examiner* — Shiref M Mekhaeil

(57) ABSTRACT

The ladder convertible to a scaffold is a self-standing ladder that is able to convert into a scaffold. The self-standing ladder is constructed of two ladder members that are able to attach to and pivot with respect to one another via a removable cap. The two ladder members also attach to one another via a foldable platform, which provides support when the two ladder members are pivoted away from one another in a self-standing configuration. The two ladder members may be disconnected to one another, and held in parallel arrangement with respect to one another via the foldable platform. The foldable platform is able to span a scaffold length between the two ladder members in order to form a scaffold. A pair of guar members attach to the two ladder members to provide guide rails on opposing sides of the scaffold.

6 Claims, 5 Drawing Sheets

(56) References Cited

U.S. PATENT DOCUMENTS 4,989,692 A * 2/1991 Min ..... E06C 1/125 182/166
5,332,062 A * 7/1994 Revere ..... E04G 1/34 182/118
5,358,069 A 10/1994 Krause
6,422,344 B1 * 7/2002 Cox ..... E06C 1/32 182/107
6,533,070 B1 * 3/2003 Elrod ..... E06C 1/345 182/103
6,997,282 B1 * 2/2006 Sharp ..... E06C 1/39 182/129
7,228,936 B2 * 6/2007 Wyse ..... E04G 1/24 182/12
8,042,653 B2 10/2011 Grebinoski
8,186,480 B1 5/2012 Yoakum, Jr.
8,381,873 B2 2/2013 Cross
8,448,748 B2 * 5/2013 Allred, III ..... E04C 3/40 182/115
2004/0200669 A1 * 10/2004 Saccente ..... E06C 1/12 182/204
2006/0076190 A1 * 4/2006 Crain ..... E06C 1/22 182/166
2009/0133959 A1 * 5/2009 Eriksson ..... E04G 1/34 182/118
2010/0071994 A1 * 3/2010 Tseng ..... E06C 1/125 182/27
2010/0071996 A1 * 3/2010 Huang ..... E04G 1/34 182/118
2010/0224445 A1 * 9/2010 Moss ..... E06C 1/387 182/129
2010/0282540 A1 11/2010 Moss
2011/0056764 A1 * 3/2011 Cross ..... E06C 1/32 182/27
2012/0132480 A1 * 5/2012 Gomez Varela ..... B65G 69/30 182/21
2012/0152652 A1 6/2012 Gabriel
2016/0208553 A1 * 7/2016 Wayland ..... E06C 7/423

* cited by examiner

LADDER CONVERTIBLE TO A SCAFFOLD

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of ladders, more specifically, a ladder that is able to convert into a scaffold.

SUMMARY OF INVENTION

The ladder convertible to a scaffold is a self-standing ladder that is able to convert into a scaffold. The self-standing ladder is constructed of two ladder members that are able to attach to and pivot with respect to one another via a removable cap. The two ladder members also attach to one another via a foldable platform, which provides support when the two ladder members are pivoted away from one another in a self-standing configuration. The two ladder members may be disconnected to one another, and held in parallel arrangement with respect to one another via the foldable platform. The foldable platform is able to span a scaffold length between the two ladder members in order to form a scaffold. A pair of guard members attach to the two ladder members to provide guide rails on opposing sides of the scaffold.

It is an object of the invention to provide a modular ladder system that is convertible to either a self-standing ladder as well as a scaffold.

It is a further object of the invention for the componentry of the modular ladder system to be supported on a component when not in use as either a scaffold or as a self-standing ladder.

These together with additional objects, features and advantages of the ladder convertible to a scaffold will be readily apparent to those of ordinary skill in the art upon reading the following detailed description of the presently preferred, but nonetheless illustrative, embodiments when taken in conjunction with the accompanying drawings.

In this respect, before explaining the current embodiments of the ladder convertible to a scaffold in detail, it is to be understood that the ladder convertible to a scaffold is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the ladder convertible to a scaffold.

It is therefore important that the claims be regarded as including such equivalent construction insofar as they do not depart from the spirit and scope of the ladder convertible to a scaffold. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
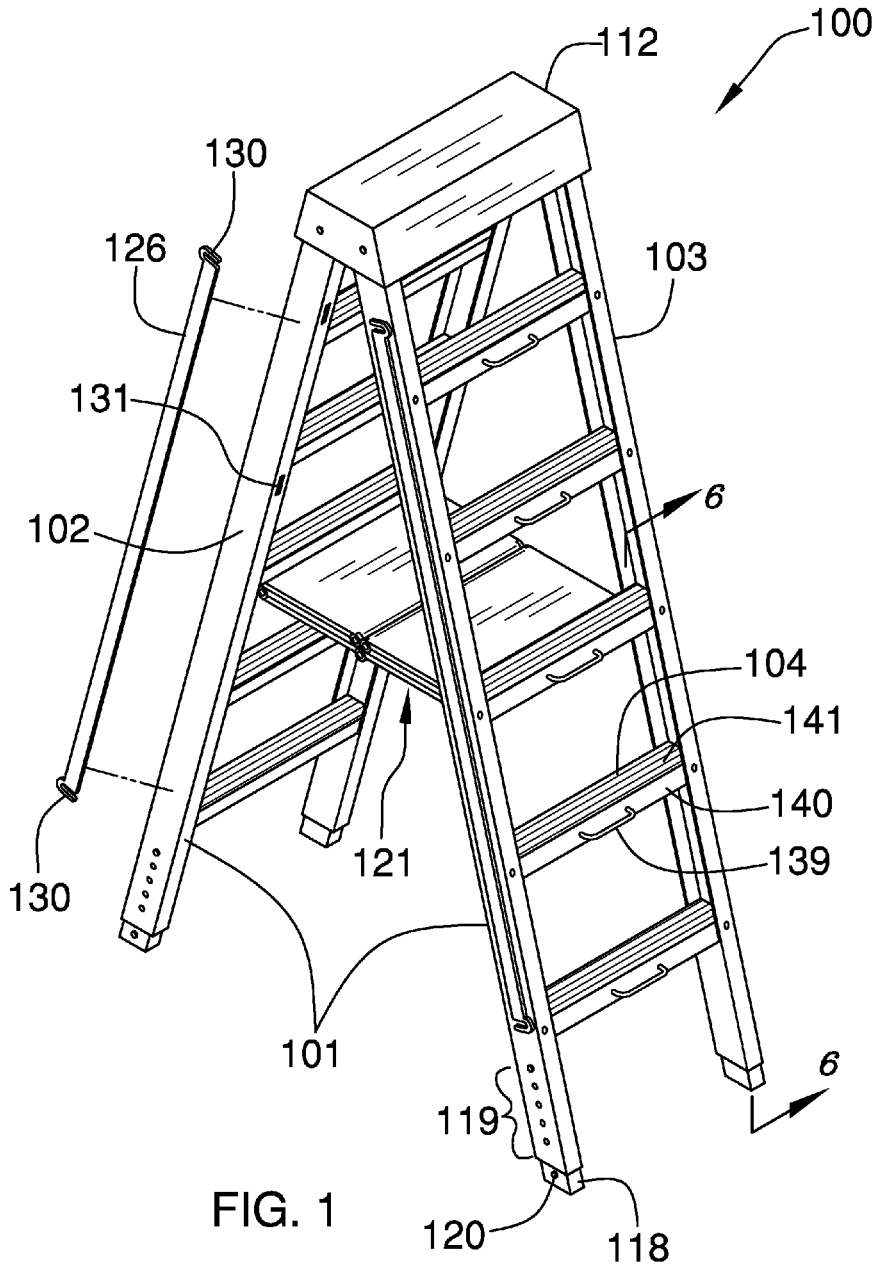
FIG. 1 is a perspective view of an embodiment of the disclosure as a ladder.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 6.

The ladder convertible to a scaffold 100 (hereinafter invention) comprises a two ladder members 101. The two ladder members 101 are identical from one another, and are used to form a self-standing ladder (see FIG. 1) or a scaffold (see FIG. 2).

The two ladder members 101 may be further defined as a first ladder member 102 and a second ladder member 103. Both the first ladder member 102 and the second ladder member 103 are each further defined with a plurality of steps 104. The plurality of steps 104 are parallel with one another and extends between a first ladder arm 105 and a second ladder arm 106. The first ladder arm 105 and the second ladder arm 106 are parallel with one another. The first ladder arm 105 and the second ladder arm 106 are constructed with a "C"-cross section. The plurality of steps 104 is further defined with a first step end 107 and a second step end 108. The first step end 107 and the second step end 108 are partially nested with respect to the "C" cross-section of the first ladder arm 105 and the second ladder arm 106.

The first ladder arm 105 and the second ladder arm 106 are each further defined with a top end 109 and a bottom end 110. Adjacent to the top end 109 is a spring-loaded pin 111. A removable cap 112 is included with the invention 100, and connects to the spring-loaded pins 111 of the first ladder arm 105 and the second ladder arm 106 of the first ladder member 102 and the second ladder member 103. The spring-loaded pins 111 are also provided on an outer surface 113 of the first ladder arm 105 as well as the second ladder arm 106.

The removable cap 112 has a trapezoidal shape with a first end 114 and a second end 115. Both the first end 114 and the second end 115 of the removable cap 112 include pin holes 116 that are able to align with the spring-loaded pins 111 of the first ladder arm 105 and the second ladder arm 106 of the first ladder member 102 and the second ladder member 103. The removable cap 112 enables the top end 109 of the first ladder member 102 and the second ladder member 103 to rest against an inner surface 117 of the removable cap 112. Moreover, the removable cap 112 enables the first ladder member 102 and the second ladder member 103 to pivot relative to one another in order to form a self-standing ladder (see FIG. 1).

The bottom end 110 of the first ladder arm 105 and the second ladder arm 106 includes a telescoping foot 118. The telescoping foot 118 is able to retract into or extend out of the bottom end 110. The outer surface 113 of the first ladder arm 105 and the second ladder arm 106 include a plurality of foot pin holes 119 that enable a foot spring-loaded pin 120 to intersect with in order to adjust the telescoping foot 118 relative to the bottom end 110. The telescoping foot 118 enables the invention 100 to form a sturdy balance when in use as either a self-standing ladder or as a scaffold.

Figure 3:
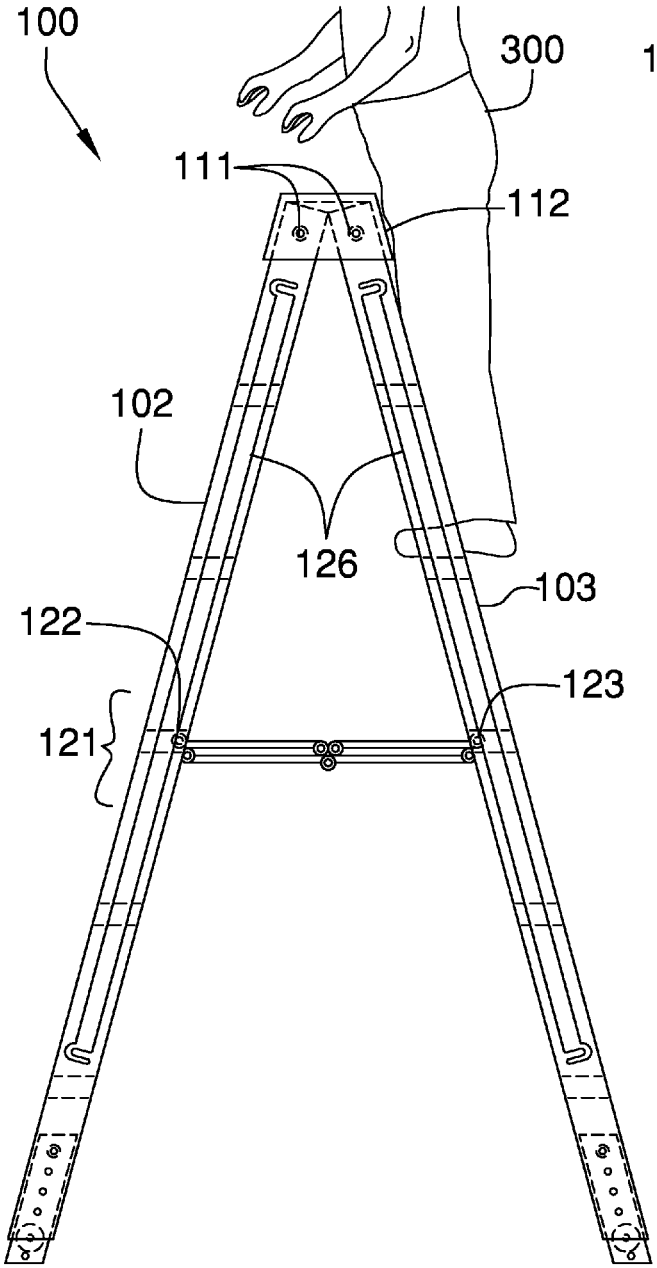
FIG. 3 is a side view of an embodiment of the disclosure as a self-standing ladder.
Figure 4:
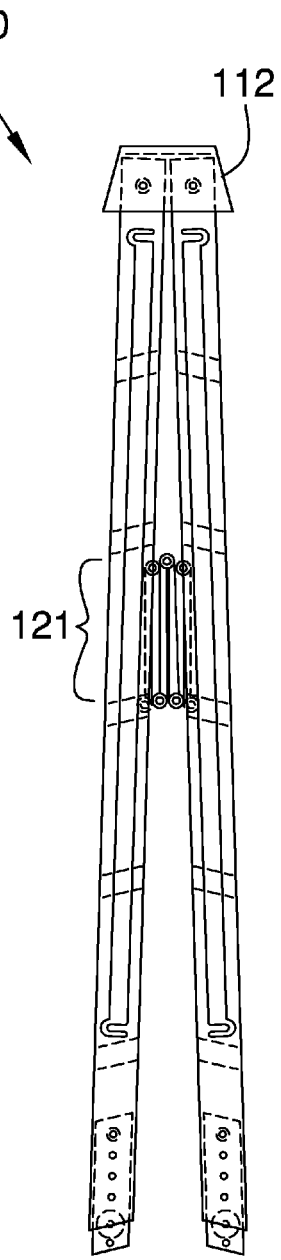
FIG. 4 is a side view of an embodiment of the disclosure as a self-standing ladder that is folded up.
Figure 5:
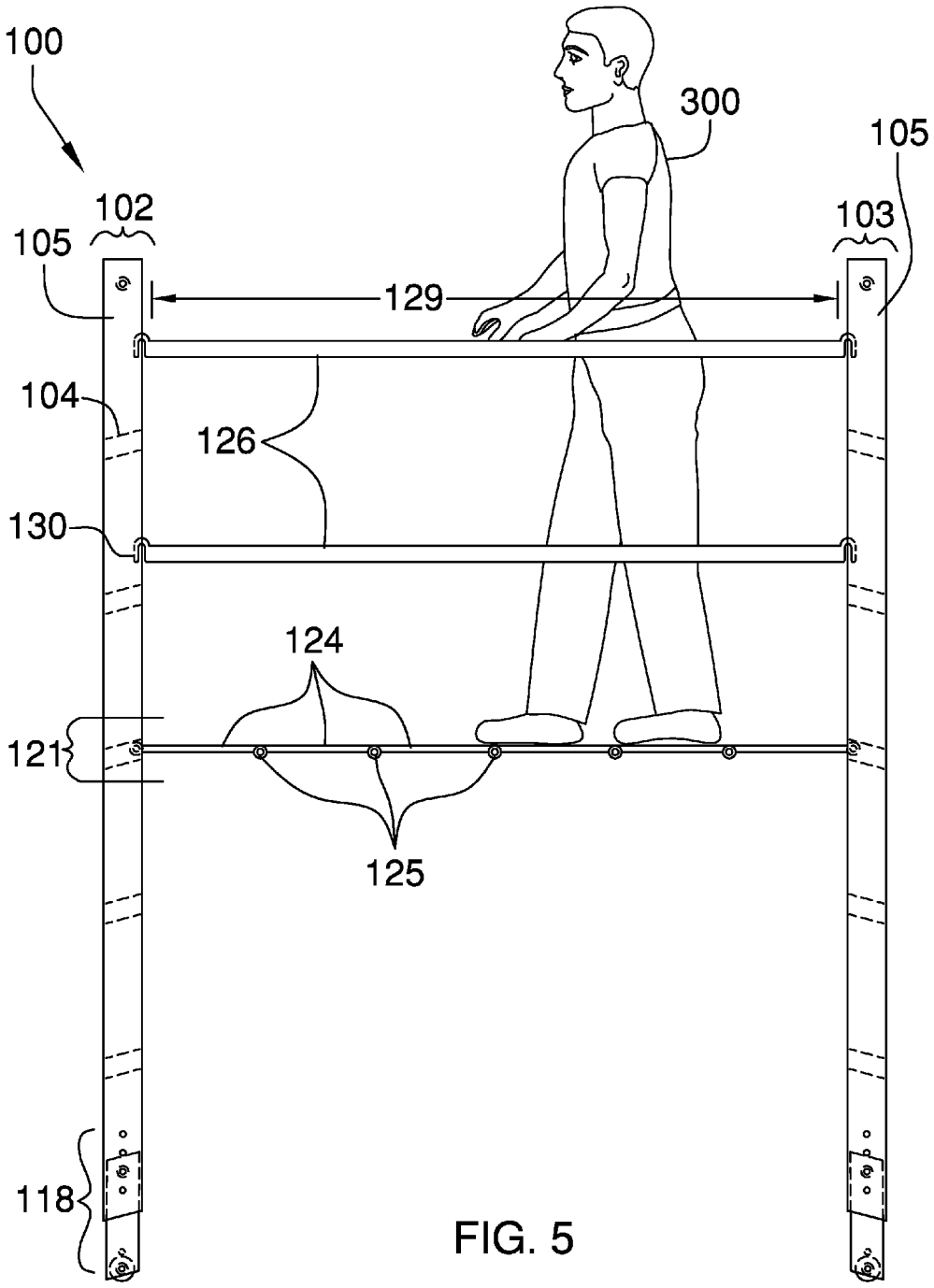
FIG. 5 is a side view of an embodiment of the disclosure erected as a scaffold.

The invention 100 includes a foldable platform 121 that attaches to the first ladder arm 105 and the second ladder arm 106 of both the first ladder member 102 and the second ladder member 103. Moreover, the foldable platform 121 is further defined with a first platform end 122 and a second platform end 123. The first platform end 122 is pivotably attached to the first ladder member 102. The second platform end 123 is pivotably attached to the second ladder member 103. The foldable platform 121 is comprised of a plurality of platform sections 124 that are each attached to one another via a locking hinge 125. The plurality of platform sections 124 are linearly aligned and span between the first platform end 122 and the second platform end 123. The foldable platform 121 is able to extend when in use as a scaffold (see FIG. 2) or collapse when supporting the invention as a self-standing ladder (see FIGS. 1 and 3-4). Referring to FIGS. 3 and 4, the foldable platform 121 folds a plurality of times to fully collapse (see FIG. 4) or partially collapse (see FIG. 3).

The invention 100 includes a plurality of guard rails 126. The plurality of guard rails 126 are further defined with a first rail end 127 and a second rail end 128. The first rail end 127 is opposite the second rail end 128. Moreover, the first rail end 127 and the second rail end 128 define a rail length 129. The plurality of guard rails 126 is made with a hook member 130 provided at the first rail end 127 and the second rail end 128. The hook member 130 is used to secure the plurality of guard rails 126 between the first ladder member 102 and the second ladder member 103. The first ladder arm 105 and the second ladder arm 106 is further defined with hook slots 131 provided on an inward surface 132. The hook members 130 hook onto the hook slots 131 in order to further secure the first ladder member 102 relative the second ladder member 103.

Figure 2:
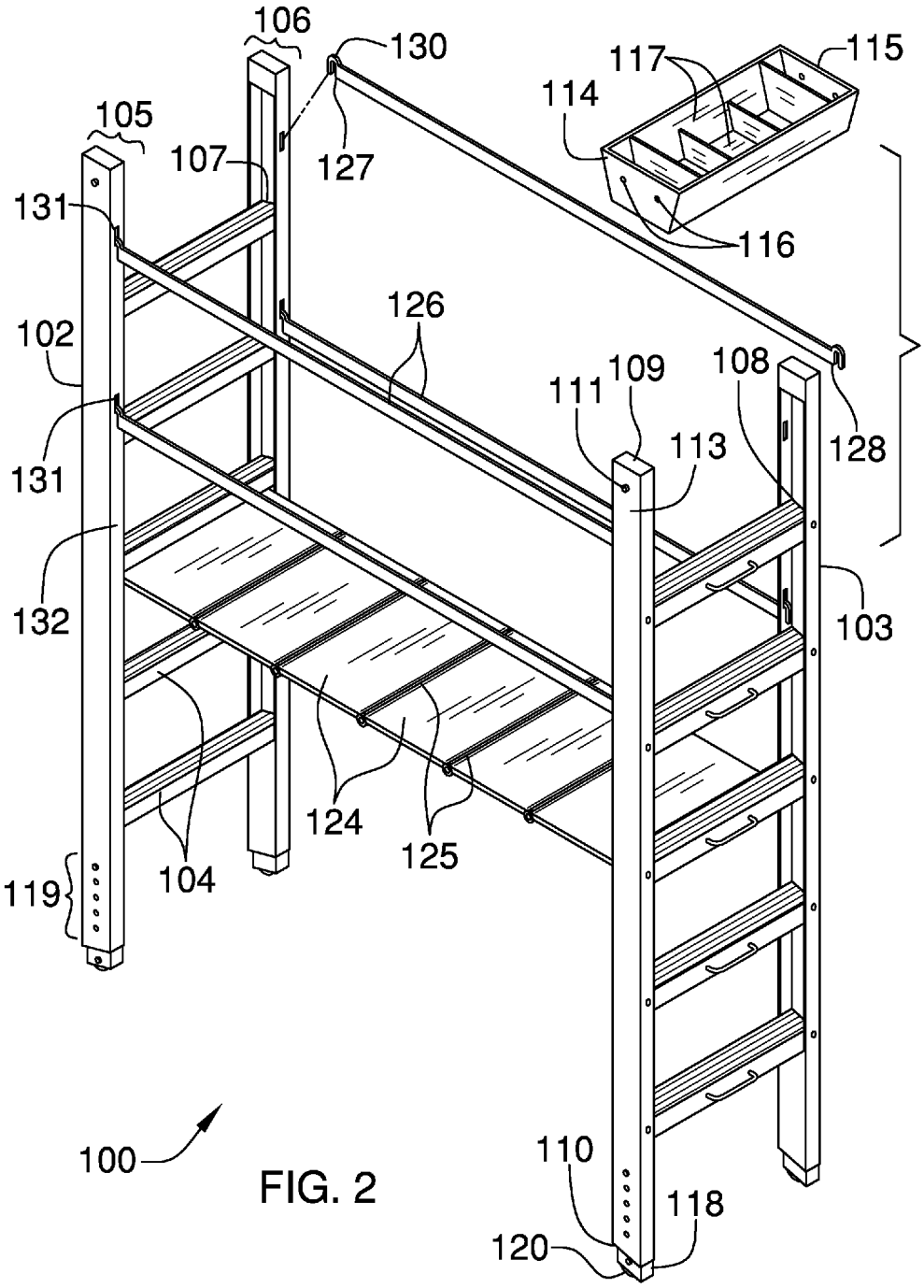
FIG. 2 is a perspective view of an embodiment of the disclosure as a scaffold.

Referring to FIG. 2, the plurality of guard rails 126 extend between the first ladder arms 105 of the first ladder member 102 and the second ladder member 103. Moreover, the plurality of guard rails 126 are also used to extend between the second ladder arms 106 of the first ladder member 102 and the second ladder member 103. The plurality of guard rails 126 are made of a generally elongated strip of metal, which may be magnetized.

When not in use, the plurality of guard rails 126 may be able to attach themselves to a lateral surface 132 of either the first ladder arm 105 or the second ladder arm 105 of the first ladder member 102 and the second ladder member 103 (see FIG. 1). That being said, the first ladder arm 105 and the second ladder arm 106 may be made of a ferrous material or be magnetized so as to provide the magnetic attraction needed to secure the plurality of guard rails 126 thereto. When in use, the plurality of guard rails 126 is generally parallel with respect to the foldable platform 121 in order to provide enhanced security when the invention 100 is in use as a scaffold. It shall be noted that when the invention 100 is in use as a scaffold, the removable top 112 is not needed.

Figure 6:
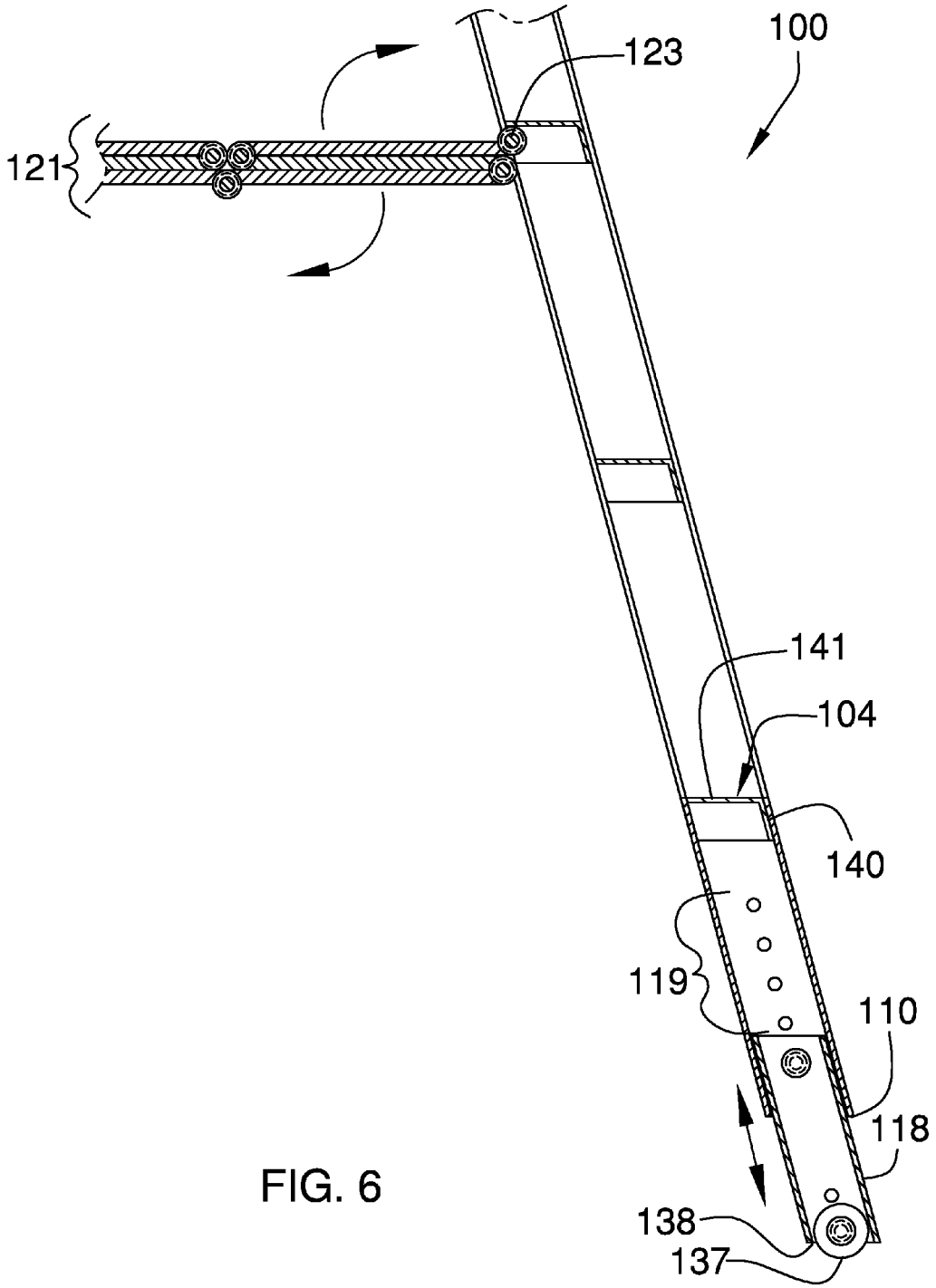
FIG. 6 is a cross-sectional view of an embodiment of the disclosure along line 6-6 in FIG. 1.

Referring to FIG. 6, the telescoping feet 118 may each include a roller wheel 137 at a bottom foot surface 138. The roller wheel 137 provides mobility to the invention 100. The plurality of steps 104 may include a handle 139 that extends outwardly with respect to the plurality of steps 104. Each of the plurality of steps 104 is further defined with an outer step surface 140, and the handle 139 extends from the outer step surface 140. The outer step surface 140 is adjacent to a tread surface 141 of the respective one of the plurality of steps 104.

It shall be noted that an end user 300 is depicted in some of the figures, and which is being done for purely illustrative purposes. The end user 300 may tread across the foldable platform 121 when the invention 100 is erected as a scaffold. Alternatively, the end user 300 may climb up the plurality of steps 104 of either the first ladder member 102 or the second ladder member 103 when the invention 100 is erected as a self-standing ladder.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A ladder comprising:

said ladder is able to convert from a self-standing ladder to a scaffold;

wherein said ladder is further defined with two ladder members that are able to attach to and pivot with respect to one another via a removable cap, and operate as the self-standing ladder;

wherein the two ladder members are optionally separated and supported in a parallel arrangement via a foldable platform;

wherein the two ladder members are identical to one another;

wherein the two ladder members are further defined as a first ladder member and a second ladder member;

wherein both the first ladder member and the second ladder member are each further defined with a plurality of steps;

wherein the plurality of steps are parallel with one another and extends between a first ladder arm and a second ladder arm; wherein the first ladder arm and the second ladder arm are parallel with one another;

wherein the first ladder arm and the second ladder arm are constructed with a "C"-cross section;

wherein the plurality of steps is further defined with a first step end and a second step end;

wherein the first step end and the second step end are partially nested with respect to the "C" cross-section of the first ladder arm and the second ladder arm;

wherein the first ladder arm and the second ladder arm are each further defined with a top end and a bottom end;

wherein adjacent to the top end is a spring-loaded pin;

wherein the removable cap connects to the spring-loaded pins of both the first ladder arm and the second ladder arm of both the first ladder member and the second ladder member;

wherein the spring-loaded pins are provided on an outer surface of the first ladder arm as well as the second ladder arm;

wherein the removable cap has a trapezoidal shape with a first end and a second end;

wherein both the first end and the second end of the removable cap include pin holes that are able to align with the spring-loaded pins of the first ladder arm and the second ladder arm of the first ladder member and the second ladder member;

wherein the removable cap enables the top end of the first ladder member and the second ladder member to rest against an inner surface of the removable cap;

wherein the removable cap enables the first ladder member and the second ladder member to pivot relative to one another in order to form a self-standing ladder;

wherein the bottom end of the first ladder arm and the second ladder arm includes a telescoping foot;

wherein the telescoping foot is able to retract into or extend out of the bottom end;

wherein the outer surface of the first ladder arm and the second ladder arm include a plurality of foot pin holes that enable a foot spring-loaded pin to intersect with in order to adjust the telescoping foot relative to the bottom end;

wherein the telescoping foot is adjustable to balance the first ladder arm relative the second ladder arm when in use as either the self-standing ladder or as the scaffold;

wherein the foldable platform attaches to the first ladder arm and the second ladder arm of both the first ladder member and the second ladder member;

wherein the foldable platform is further defined with a first platform end and a second platform end;

wherein the first platform end is pivotably attached to the first ladder member;

wherein the second platform end is pivotably attached to the second ladder member;

wherein the foldable platform is comprised of a plurality of platform sections that are each attached to one another via a locking hinge;

wherein the plurality of platform sections are linearly aligned and span between the first platform end and the second platform end;

wherein the foldable platform is able to extend when in use as the scaffold or collapse when supporting the first ladder member and the second ladder member as the self-standing ladder;

wherein a plurality of guard rails are included, and are further defined with a first rail end and a second rail end;

wherein the first rail end is opposite the second rail end;

wherein the first rail end and the second rail end define a rail length;

wherein the plurality of guard rails is made with a hook member provided at the first rail end and the second rail end;

wherein the hook member is used to secure the plurality of guard rails between the first ladder member and the second ladder member;

wherein the first ladder arm and the second ladder arm is further defined with hook slots provided on an inward surface;

wherein the hook members hook onto the hook slots in order to further secure the first ladder member relative the second ladder member.

2. The ladder according to claim 1 wherein the plurality of guard rails extend between the first ladder arms of the first ladder member and the second ladder member; wherein the plurality of guard rails are also used to extend between the second ladder arms of the first ladder member and the second ladder member; wherein the plurality of guard rails are made of a generally elongated strip.

3. The ladder according to claim 2 wherein the plurality of guard rails are able to attach themselves to a lateral surface of either the first ladder arm or the second ladder arm of the first ladder member and the second ladder member; wherein in use, the plurality of guard rails are generally parallel with respect to the foldable platform in order to provide enhanced security when in use as the scaffold; wherein the plurality of guard rails are located above and parallel with the foldable platform such that the foldable platform is adapted to be tread upon whereas the plurality of guard rails is optionally grasped.

4. The ladder according to claim 3 wherein the telescoping feet each include a roller wheel at a bottom foot surface; wherein the roller wheel provides mobility to first ladder member as well as the second ladder member.

5. The ladder according to claim 4 wherein each of the plurality of steps include a handle that extends outwardly with respect to the plurality of steps.

6. The ladder according to claim 5 wherein each of the plurality of steps is further defined with an outer step surface, and the handle extends from the outer step surface; wherein the outer step surface is adjacent to a tread surface of the respective one of the plurality of steps.

* * * * *